US008216118B2

(12) United States Patent
Dunn

(10) Patent No.: US 8,216,118 B2
(45) Date of Patent: Jul. 10, 2012

(54) CARTON WITH MULTI-PLY HANDLE

(75) Inventor: Jackie W. Dunn, West Monroe, LA (US)

(73) Assignee: Graphic Packaging International, Inc., Marietta, GA (US)

( * ) Notice: Subject to any disclaimer, the term of this patent is extended or adjusted under 35 U.S.C. 154(b) by 19 days.

(21) Appl. No.: 12/797,635

(22) Filed: Jun. 10, 2010

(65) Prior Publication Data

US 2010/0243721 A1 Sep. 30, 2010

Related U.S. Application Data

(62) Division of application No. 11/680,867, filed on Mar. 1, 2007, now Pat. No. 7,757,933.

(60) Provisional application No. 60/777,858, filed on Mar. 1, 2006.

(51) Int. Cl.
*B31B 1/26* (2006.01)
*B31B 1/62* (2006.01)

(52) U.S. Cl. ..... 493/128; 229/117.13; 493/162; 493/909

(58) Field of Classification Search ..... 229/117.12, 229/117.13; 206/141, 427; 493/909
See application file for complete search history.

(56) References Cited

U.S. PATENT DOCUMENTS

| | | | |
|---|---|---|---|
| 1,253,193 | A | 1/1918 | Hill |
| 2,383,183 | A | 8/1945 | Fischer |
| 2,594,376 | A | 4/1952 | Arneson |
| 2,702,144 | A | 2/1955 | Forrer |
| 2,797,856 | A | 7/1957 | Jaeschke |
| 2,810,506 | A | 10/1957 | Kessler |
| 2,868,433 | A | 1/1959 | Anderson, Jr. |
| 2,955,739 | A | 10/1960 | Collura |
| 3,112,856 | A | 12/1963 | MacIntosh et al. |
| 3,127,720 | A | 4/1964 | Gentry et al. |
| 3,204,814 | A | 9/1965 | Mahon |
| 3,204,815 | A | 9/1965 | Weiss |
| 3,309,005 | A | 3/1967 | Pilger |

(Continued)

FOREIGN PATENT DOCUMENTS

| | | |
|---|---|---|
| CA | 877792 | 8/1971 |
| CA | 2 160 145 | 9/1995 |
| DE | 85 14 718.4 | 6/1985 |

(Continued)

OTHER PUBLICATIONS

Preliminary Amendment dated Nov. 7, 2007, for U.S. Appl. No. 11/680,867.

(Continued)

*Primary Examiner* — Gary Elkins
(74) *Attorney, Agent, or Firm* — Womble Carlyle Sandridge & Rice, LLP

(57) ABSTRACT

A method of forming a carton from a blank. The method comprises obtaining a blank. The blank comprising a first top panel comprising a first handle portion, a handle feature located adjacent to the first handle portion, and a reinforcing handle portion located adjacent to the first handle portion, a first side panel, a bottom panel, a second side panel foldably connected to the second top panel, and a second top panel comprising a second handle portion. The method comprises folding the reinforcing handle portion of the first top panel about the first fold line, adhering the reinforcing handle portion to the first handle portion, folding the blank so that the second top panel overlaps the first top panel, and adhering the second top panel to the first top panel.

14 Claims, 8 Drawing Sheets

U.S. PATENT DOCUMENTS

| | | | | |
|---|---|---|---|---|
| 3,334,767 | A | | 8/1967 | Cornelius et al. |
| 3,355,012 | A | | 11/1967 | Weiss |
| 3,381,881 | A | | 5/1968 | Granz et al. |
| 3,828,926 | A | | 8/1974 | Rossi |
| 3,886,901 | A | | 6/1975 | Zeitler |
| 3,894,681 | A | * | 7/1975 | Arneson et al. ..... 206/141 |
| 3,904,036 | A | | 9/1975 | Forrer |
| 3,933,303 | A | | 1/1976 | Kirby, Jr. |
| 3,994,432 | A | | 11/1976 | Kirby, Jr. |
| 4,029,204 | A | | 6/1977 | Manizza |
| 4,036,423 | A | | 7/1977 | Gordon |
| 4,096,985 | A | | 6/1978 | Wood |
| 4,111,306 | A | | 9/1978 | Roccaforte |
| 4,216,861 | A | | 8/1980 | Oliff |
| 4,318,474 | A | | 3/1982 | Hasegawa |
| 4,328,923 | A | | 5/1982 | Graser |
| 4,329,923 | A | | 5/1982 | Iida |
| 4,331,289 | A | | 5/1982 | Killy |
| 4,364,509 | A | | 12/1982 | Holley et al. |
| 4,375,258 | A | | 3/1983 | Crayne et al. |
| 4,378,905 | A | | 4/1983 | Roccaforte |
| 4,382,505 | A | | 5/1983 | Sutherland et al. |
| 4,396,143 | A | * | 8/1983 | Killy ..... 206/427 |
| 4,418,864 | A | | 12/1983 | Nielsen |
| 4,424,901 | A | | 1/1984 | Lanier |
| 4,440,340 | A | | 4/1984 | Bakx |
| 4,478,334 | A | | 10/1984 | Graser |
| 4,498,619 | A | | 2/1985 | Roccaforte |
| 4,508,258 | A | | 4/1985 | Graser |
| 4,538,759 | A | | 9/1985 | Dutcher |
| 4,545,485 | A | | 10/1985 | Oliff |
| 4,546,914 | A | | 10/1985 | Rocca |
| 4,577,799 | A | | 3/1986 | Oliff |
| 4,588,084 | A | | 5/1986 | Holley, Jr. |
| 4,653,686 | A | | 3/1987 | Wood et al. |
| 4,706,876 | A | | 11/1987 | Wilson |
| 4,747,487 | A | | 5/1988 | Wood |
| 4,784,266 | A | | 11/1988 | Chaussadas |
| 4,784,316 | A | | 11/1988 | Crouch |
| 4,802,583 | A | | 2/1989 | Calvert et al. |
| 4,830,267 | A | | 5/1989 | Wilson |
| 4,875,586 | A | | 10/1989 | Chaussadas |
| 4,966,324 | A | | 10/1990 | Steel |
| 5,020,337 | A | | 6/1991 | Krieg |
| 5,060,792 | A | | 10/1991 | Oliff |
| 5,072,876 | A | | 12/1991 | Wilson |
| 5,094,359 | A | | 3/1992 | DeMars et al. |
| 5,106,014 | A | | 4/1992 | Miller |
| 5,119,985 | A | | 6/1992 | Dawson et al. |
| 5,197,598 | A | | 3/1993 | Stout et al. |
| 5,221,041 | A | | 6/1993 | Stout et al. |
| 5,222,658 | A | | 6/1993 | De Maio et al. |
| 5,234,102 | A | | 8/1993 | Schuster et al. |
| 5,246,112 | A | | 9/1993 | Stout et al. |
| 5,284,294 | A | | 2/1994 | Floyd |
| 5,292,058 | A | | 3/1994 | Zoss et al. |
| 5,297,725 | A | | 3/1994 | Sutherland |
| 5,303,863 | A | | 4/1994 | Arasim |
| 5,307,932 | A | | 5/1994 | Stout et al. |
| 5,307,986 | A | | 5/1994 | Schuster |
| 5,320,277 | A | | 6/1994 | Stout et al. |
| 5,328,081 | A | * | 7/1994 | Saulas ..... 229/117.12 |
| 5,333,734 | A | | 8/1994 | Stout et al. |
| D350,480 | S | | 9/1994 | Sutherland |
| 5,379,944 | A | | 1/1995 | Stout et al. |
| 5,381,891 | A | | 1/1995 | Harris |
| 5,385,234 | A | | 1/1995 | Stout et al. |
| 5,395,044 | A | | 3/1995 | Stout |
| 5,427,241 | A | | 6/1995 | Sutherland |
| 5,458,234 | A | | 10/1995 | Harris |
| 5,472,090 | A | | 12/1995 | Sutherland |
| 5,485,915 | A | | 1/1996 | Harris |
| 5,495,727 | A | | 3/1996 | Strong et al. |
| 5,524,756 | A | | 6/1996 | Sutherland |
| 5,551,556 | A | | 9/1996 | Sutherland |
| 5,582,343 | A | | 12/1996 | Dalvey |
| 5,639,017 | A | | 6/1997 | Fogle |
| 5,647,483 | A | | 7/1997 | Harris |
| 5,669,500 | A | | 9/1997 | Sutherland |
| 5,699,957 | A | | 12/1997 | Bin et al. |
| 5,704,470 | A | | 1/1998 | Sutherland |
| 5,738,273 | A | | 4/1998 | Auclair |
| 5,794,778 | A | | 8/1998 | Harris |
| 5,826,782 | A | | 10/1998 | Stout |
| 5,873,515 | A | | 2/1999 | Dunn et al. |
| 5,878,946 | A | | 3/1999 | Frerot et al. |
| 5,906,313 | A | | 5/1999 | Oliff |
| 5,915,546 | A | | 6/1999 | Harrelson |
| 5,992,733 | A | | 11/1999 | Gomes |
| 6,019,276 | A | | 2/2000 | Auclair |
| 6,021,897 | A | | 2/2000 | Sutherland |
| 6,065,590 | A | | 5/2000 | Spivey |
| 6,085,969 | A | | 7/2000 | Burgoyne |
| 6,105,853 | A | | 8/2000 | Lamare |
| 6,105,854 | A | | 8/2000 | Spivey et al. |
| 6,112,977 | A | | 9/2000 | Sutherland et al. |
| 6,129,266 | A | | 10/2000 | Oliff et al. |
| 6,131,803 | A | | 10/2000 | Oliff et al. |
| 6,164,526 | A | | 12/2000 | Dalvey |
| 6,170,741 | B1 | | 1/2001 | Skolik et al. |
| 6,227,367 | B1 | | 5/2001 | Harrelson et al. |
| 6,260,755 | B1 | | 7/2001 | Bates et al. |
| 6,302,320 | B1 | | 10/2001 | Stout |
| D452,154 | S | | 12/2001 | Rhodes et al. |
| 6,425,520 | B1 | | 7/2002 | Peterson |
| 6,523,739 | B2 | | 2/2003 | Heeley et al. |
| 6,536,656 | B2 | | 3/2003 | Auclair et al. |
| 6,631,803 | B2 | | 10/2003 | Rhodes et al. |
| 6,758,337 | B2 | | 7/2004 | Chargueraud et al. |
| 6,766,940 | B2 | | 7/2004 | Negelen |
| 6,834,793 | B2 | | 12/2004 | Sutherland |
| 6,848,573 | B2 | | 2/2005 | Gould et al. |
| 6,869,009 | B2 | | 3/2005 | Sutherland et al. |
| 6,905,066 | B2 | | 6/2005 | Holley et al. |
| 6,926,193 | B2 | | 8/2005 | Smalley |
| 6,945,450 | B2 | | 9/2005 | Rusnock |
| 6,968,992 | B2 | | 11/2005 | Schuster |
| 7,234,596 | B2 | | 6/2007 | Lebras |
| 7,296,731 | B2 | | 11/2007 | Auclair et al. |
| 7,380,701 | B2 | | 6/2008 | Fogle et al. |
| 7,416,109 | B2 | | 8/2008 | Sutherland |
| 7,427,010 | B2 | | 9/2008 | Sutherland |
| 7,472,791 | B2 | | 1/2009 | Spivey, Sr. |
| 7,601,111 | B2 | | 10/2009 | Sutherland et al. |
| 7,699,215 | B2 | | 4/2010 | Spivey, Sr. |
| 7,743,944 | B2 | | 6/2010 | Ho Fung et al. |
| 7,743,968 | B2 | | 6/2010 | Theelen |
| 7,748,603 | B2 | | 7/2010 | Fogle et al. |
| 7,757,933 | B2 | | 7/2010 | Dunn |
| 7,793,779 | B2 | | 9/2010 | Spivey, Sr. et al. |
| 7,806,314 | B2 | | 10/2010 | Sutherland |
| 2003/0213263 | A1 | | 11/2003 | Woog |
| 2004/0050917 | A1 | | 3/2004 | Smalley |
| 2004/0074954 | A1 | | 4/2004 | Fogle et al. |
| 2005/0056658 | A1 | | 3/2005 | Spivey |
| 2005/0087592 | A1 | | 4/2005 | Schuster |
| 2005/0167478 | A1 | | 8/2005 | Holley, Jr. |
| 2006/0071058 | A1 | | 4/2006 | Spivey |
| 2006/0169755 | A1 | | 8/2006 | Spivey, Sr. |
| 2006/0273143 | A1 | | 12/2006 | Finch |
| 2007/0039846 | A1 | | 2/2007 | Spivey |
| 2007/0051781 | A1 | | 3/2007 | Holley, Jr. |
| 2007/0108261 | A1 | | 5/2007 | Schuster |
| 2007/0164091 | A1 | | 7/2007 | Fogle et al. |
| 2007/0181658 | A1 | | 8/2007 | Sutherland |
| 2007/0205255 | A1 | | 9/2007 | Dunn |
| 2007/0284424 | A1 | | 12/2007 | Holley |
| 2007/0295789 | A1 | | 12/2007 | Ho Fung |
| 2008/0083820 | A1 | | 4/2008 | Walling et al. |
| 2008/0099544 | A1 | | 5/2008 | Skolik |
| 2009/0236408 | A1 | | 9/2009 | Spivey, Sr. et al. |
| 2009/0255983 | A1 | | 10/2009 | DePaula et al. |
| 2010/0213249 | A1 | | 8/2010 | Requena et al. |

FOREIGN PATENT DOCUMENTS

| | | | |
|---|---|---|---|
| DE | 296 07 374 | U1 | 4/1996 |
| DE | 201 12 228 | U1 | 11/2002 |
| DE | 2004 018 649 | | 4/2005 |
| EP | 0 412 226 | A1 | 2/1991 |
| EP | 0473 266 | | 3/1992 |
| EP | 1 612 157 | A2 | 1/2006 |
| FR | 1 494 239 | | 9/1967 |
| FR | 2 579 175 | | 9/1986 |
| JP | 8503187 | | 4/1996 |
| JP | 2005507831 | | 3/2005 |
| KR | 20-0356729 | Y1 | 7/2004 |
| WO | 9410047 | | 5/1994 |
| WO | WO 96/27538 | | 9/1996 |
| WO | WO/96/27538 | | 9/1996 |
| WO | WO 99/28207 | | 6/1999 |
| WO | WO 00/78618 | A1 | 12/2000 |
| WO | WO 01/66434 | A1 | 9/2001 |
| WO | 03037742 | A2 | 5/2003 |
| WO | WO 03/037742 | A2 | 5/2003 |
| WO | WO/2005/080218 | | 9/2005 |
| WO | WO 2005/123532 | A1 | 12/2005 |
| WO | WO/2007/089282 | | 8/2007 |

OTHER PUBLICATIONS

Office Action mailed May 5, 2009, for U.S. Appl. No. 11/680,867.
Response to Restriction Requirement, dated Jun. 4, 2009, for U.S. Appl. No. 11/680,867.
Office Action mailed Jun. 22, 2009, for U.S. Appl. No. 11/680,867.
Amendment A and Response to Office Action dated Sep. 22, 2009, for U.S. Appl. No. 11/680,867.
Office Action mailed Jan. 7, 2010, for U.S. Appl. No. 11/680,867.
Amendment C and Response to Final Office Action dated Apr. 7, 2010, for U.S. Appl. No. 11/680,867.
Notice of Allowance and Issue Fee(s) Due mailed Apr. 19, 2010 for U.S. Appl. No. 11/680,867.
International Search Report for PCT application No. PCT/US2010/025178, mailed Sep. 2, 2010.
Written Opinion for PCT application No. PCT/US US2010/025178, mailed Sep. 2, 2010.
PCT/US2009/037642—International Search Report and Written Opinion, mailed May 29, 2009.
Notification of Reason for Refusal for JP 2008-557390 dated Feb. 13, 2012 and English Translation.

* cited by examiner

CARTON WITH MULTI-PLY HANDLE

CROSS-REFERENCE TO RELATED APPLICATIONS

This application is a divisional of U.S. patent application Ser. No. 11/680,867, filed Mar. 1, 2007, which application claims the benefit of U.S. Provisional Application No. 60/777,858, filed Mar. 1, 2006.

INCORPORATION BY REFERENCE

The entire contents of U.S. patent application Ser. No. 11/680,867, filed Mar. 1, 2007, and U.S. patent application Ser. No. 60/777,858, filed Mar. 1, 2006, are hereby incorporated by reference as if presented herein in their entirety.

BACKGROUND

Cartons having dispensers and carrying handles are known. Conventional cartons, however, may have handles that are of insufficient strength to reliably transport the cartons. For example, cartons with relatively heavy loads, such as cartons accommodating beverage containers, may have handles of insufficient strength or reliability. Carton handles may be reinforced, but reinforcement often requires additional cost of manufacture.

SUMMARY

According to an exemplary first embodiment of the invention, a carton comprises a bottom panel, a top panel formed from first and second overlapping top panels, side panels, and end panels. The top panel includes a multi-ply handle comprising at least three handle plies formed from the overlapping top panels. In one embodiment, one of the handle plies is a reinforcing handle ply formed from one of the overlapping first and second top panels.

According to one aspect of the first embodiment of the invention, the multi-ply handle allows relatively heavy articles, such as beverage containers filled with liquids, for example, to be reliably transported in the carton. The plies of the handle may be formed from the overlapping first and second top panels and therefore no additional paperboard pieces are required.

According to another aspect of the first embodiment, one or more dispenser sections may be formed in the carton to provide access to the carton contents. The dispenser sections may be formed on either side of the multi-ply handle so that the carton may be carried by the handle after opening one or both sides of the carton.

In another exemplary aspect, the disclosure is generally directed to a method of forming a carton from a blank. The method comprises obtaining a blank. The blank comprises a first top panel comprising a first handle portion, a handle feature located adjacent to the first handle portion, and a reinforcing handle portion located adjacent to the first handle portion. The reinforcing handle portion is foldably connected to the first top panel at a first fold line, wherein the first handle portion is located between the handle feature and the reinforcing handle portion and the reinforcing handle portion is at least partially defined by a breachable line of disruption in the first top panel. The blank comprises a first side panel foldably connected to the first top panel at a second fold line, wherein the reinforcing handle portion is located between the first fold line and the second fold line, a bottom panel, a second side panel foldably connected to the second top panel, and a second top panel comprising a second handle portion. The method comprises folding the reinforcing handle portion of the first top panel about the first fold line so that it overlaps the first handle portion of the first top panel, adhering the reinforcing handle portion to the first handle portion, folding the blank so that the second top panel overlaps the first top panel and the second handle portion overlaps the first handle portion, and adhering the second top panel to the first top panel.

Those skilled in the art will appreciate the above stated advantages and other advantages and benefits of various additional embodiments reading the following detailed description of the embodiments with reference to the below-listed drawing figures.

BRIEF DESCRIPTION OF THE DRAWING FIGURES

According to common practice, the various features of the drawings discussed below are not necessarily drawn to scale. Dimensions of various features and elements in the drawings may be expanded or reduced to more clearly illustrate the embodiments of the invention.

DETAILED DESCRIPTION

The present invention generally relates to cartons or cartons having reinforced multi-ply carrying handles. Articles accommodated within the present carton embodiments can include containers such as, for example, petaloid bottle containers, beverage cans, glass or plastic bottles, or other containers such as, for example, those used for packaging foodstuffs. For the purposes of illustration and not for the purpose of limiting the scope of the invention, the following detailed description describes bottle beverage containers as disposed within the carton. In this specification, the terms "end," "side," "bottom," and "top" indicate orientations determined in relation to fully erected, upright cartons and are not intended to limit the scope of the invention.

Figure 1:
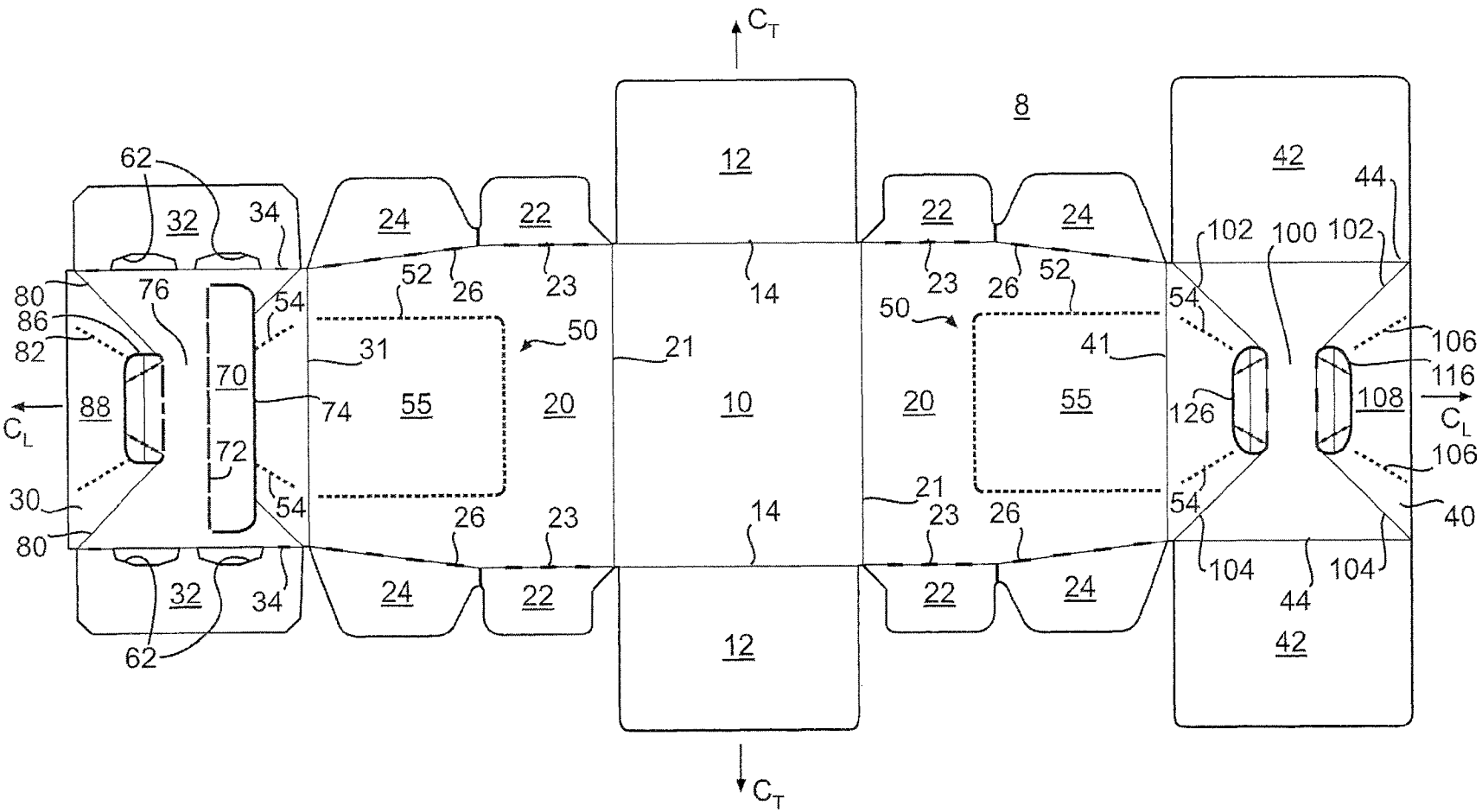
FIG. 1 is a plan view of an exterior upper or print side of a blank used to form a carton having a multi-ply handle according to a first embodiment of the invention.

FIG. 1 is a plan view of a first, upper print or exterior side of a carton blank 8 used to form a carton 190 (illustrated in FIG. 3) according to a first embodiment of the invention. The first side of the blank 8 will be disposed on the exterior of the erected carton 190. As shown in FIG. 1, the carton blank 8 may be symmetric or partially symmetric about a longitudinal center line $C_L$ and about a transverse center line $C_T$. Therefore, certain elements in the drawing figures have similar or identical reference numerals in order to reflect the whole or partial longitudinal and transverse symmetries.

The blank 8 comprises a bottom panel 10 foldably connected to a pair of side panels 20 at transverse fold lines 21, a first top or handle panel 30 foldably connected to the first side panel 20 at a transverse fold line 31, and a second top or handle panel 40 foldably connected to the second side panel 20 at a transverse fold line 41. Bottom end flaps 12 are foldably connected to opposite ends of the bottom panel 10 along longitudinal fold lines 14. Lower side end flaps 22 are foldably connected to opposite ends of the side panels 20 at longitudinal fold lines 23. Upper side end flaps 24 are disposed adjacent to the lower side end flaps 22 and are foldably connected to opposite ends of the side panels 20 at oblique fold lines 26. First top end flaps 32 are foldably connected to opposite ends of the first top panel 30 along longitudinal fold lines 34. Second top end flaps 42 are foldably connected to opposite ends of the second top panel 40 along longitudinal fold lines 44.

Dispenser patterns 50 are formed at each side of the blank 8. Each dispenser pattern 50 includes a tear line 52 extending in a side panel 20, and converging oblique tear lines 54 extending from the ends of the tear line 52 and into one of the top panels 30, 40. Each dispenser pattern 50 defines a dispenser section 55 in the panels 20, 30 and in the panels 20, 40. Oblique tear lines 82 extend in the first top panel 30 and are arranged to overlap or coincide with the oblique tear lines 54 in the second top panel 40 in the erected carton 190 (illustrated in FIG. 3). The tear lines 82 define a dispenser section 88 that is removed when the dispenser section 55 at the opposite end of the blank 8 is removed to open one side of the carton 190. Oblique tear lines 106 extend in the second top panel 40 and are arranged to coincide with the oblique tear lines 54 in the first top panel 30 in the erected carton 190. The tear lines 106 define a dispenser section 108 that is removed when the other dispenser section 55 is removed.

Figure 3:
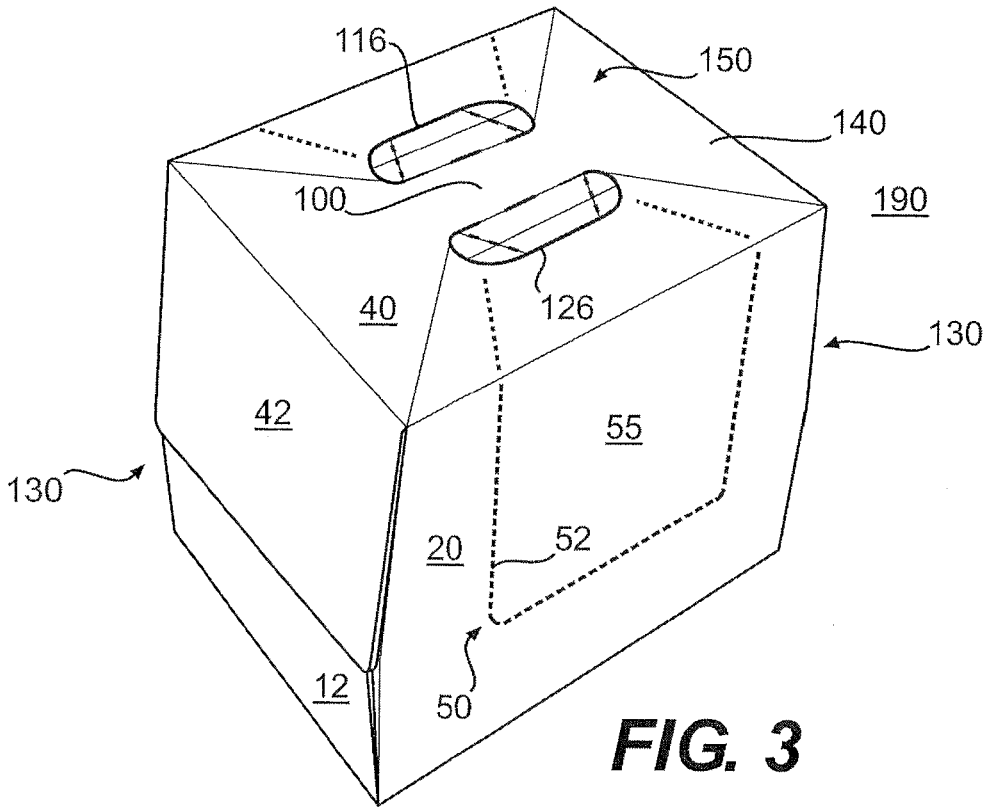
FIG. 3 illustrates the erected carton according to the first embodiment of the invention.

According to one exemplary aspect of the present invention, an elongated reinforcing handle portion 70 is defined in the first top panel 30. The reinforcing handle portion 70 comprises one ply of a multi-ply handle 150 in the erected carton 190 (FIG. 3). The reinforcing handle portion 70 is defined by a breachable line of disruption 74 and a transverse fold line 72. The reinforcing handle portion 70 is foldable with respect to the remainder of the first top panel 30 about the transverse fold line 72. The breachable line of disruption 74 may be, for example, a tear or cut line that allows the handle portion 70 to be folded with respect to the remainder of the panel 30. A first handle portion 76 of the first top panel 30 is defined in the first top panel 30 adjacent to the reinforcing handle portion 70. The first handle portion 76 forms a second ply of the handle 150, and is generally defined between a breachable handle feature 86, the transverse fold line 72, and oblique lines of disruption 80. The oblique lines of disruption 80 may be, for example, tear lines or score lines. Apertures 62 may be formed in the first top end panels 32 along the longitudinal fold lines 34 to assist folding of the top end flaps 32 at the longitudinal fold lines 34.

A second handle portion 100 is generally defined in the second top panel 40 between breachable handle features 116, 126 and oblique lines of disruption 102, 104. The oblique lines of disruption 102, 104 may be, for example, score lines or tear lines. The second handle portion 100 is positioned to overlap the first handle portion 76 and the reinforcing handle portion 100 in the erected carton 190, and forms a third ply of the handle 150.

An exemplary method of erection of the carton 190 will now be discussed with reference to FIGS. 2A-2D. In FIGS. 2A-2D, for ease of understanding, the underside surfaces of the blank 8 are indicated by light stippling in order to distinguish the underside of the blank 8 from the upper or print side surface of the blank shown in FIG. 1, which is not stippled.

Figure 2A:
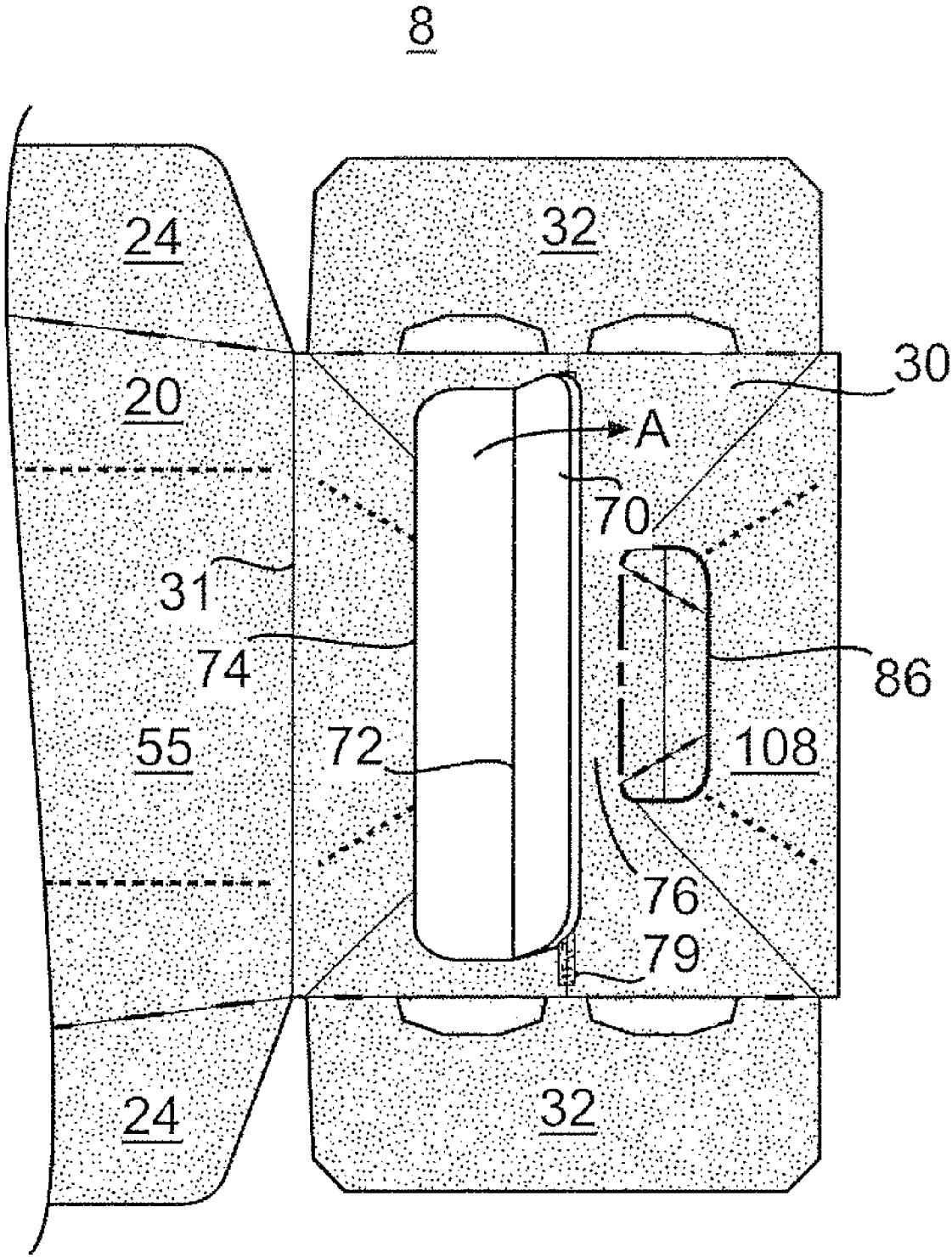
FIG. 2A is a partial view of the carton blank illustrating an initial erection step of the carton.

FIG. 2A illustrates an initial folding step of the blank 8, where the blank 8 is shown print side or exterior side down. In FIG. 2A, the reinforcing handle portion 70 is partially separated from the remainder of the first top panel 30 at the breachable line of disruption 74 and folded over in the direction of the arrow A. The reinforcing handle portion 70 is folded flat about the transverse fold line 72 to bring the underside of the reinforcing handle portion 70 into contact with the underside of the first handle portion 76. The handle portions 70, 76 are adhered together by adhesive 79.

Figure 2B:
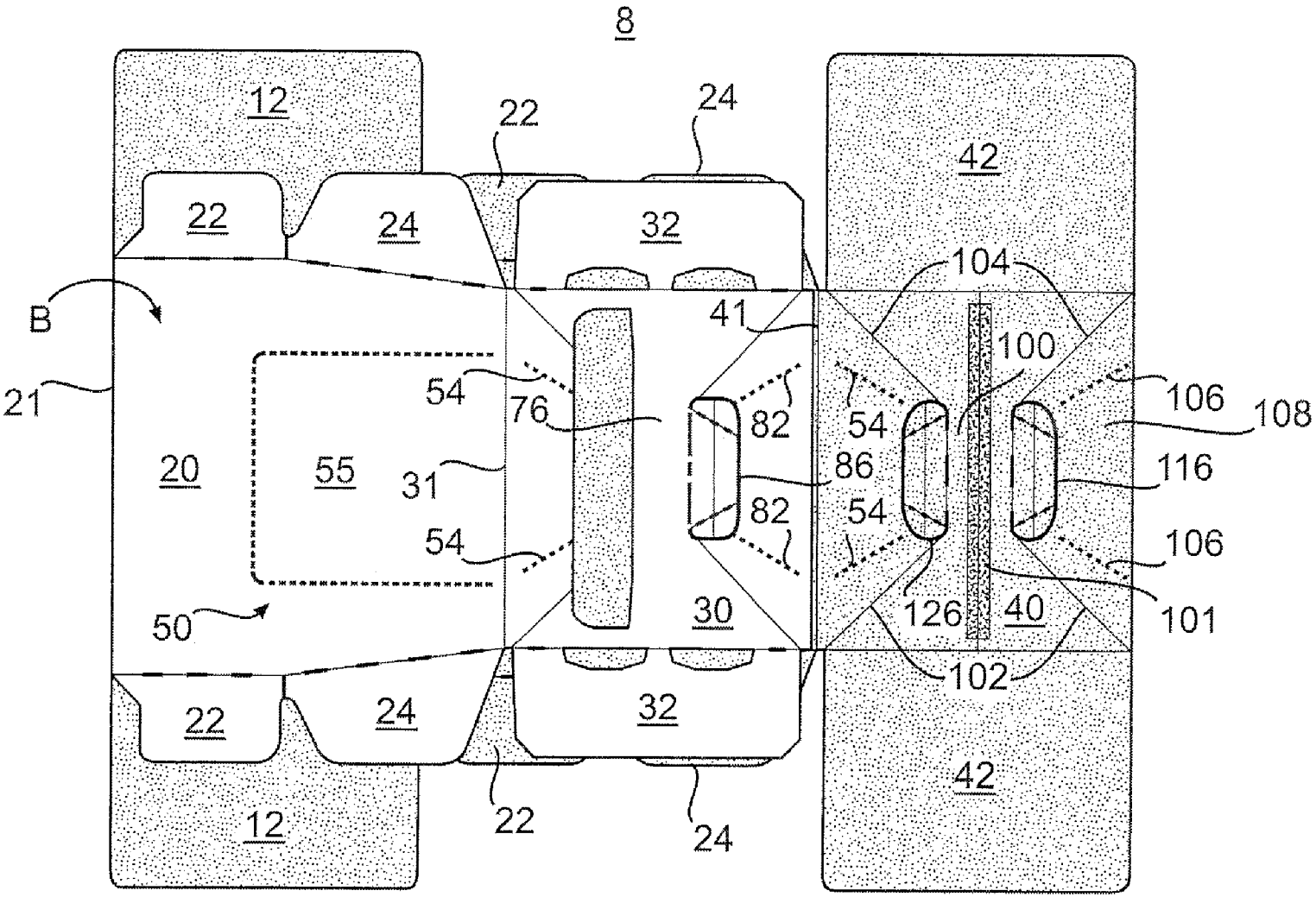
FIG. 2B illustrates an erection step of the blank according to the first embodiment.

Referring to FIG. 2B, the blank 8 is folded flat about the transverse fold line 21 in the direction of the arrow B. In FIG. 2B, the blank 8 is folded such that the first top panel 30 is print side or exterior side up and the panels 10, 40 are print side down. The reinforcing handle portion 70 is sandwiched between the first handle portion 76 and the print side down side panel 20 and is therefore not visible in FIG. 2B. Adhesive 101 is located on the underside of the second handle portion 100.

Figure 2C:
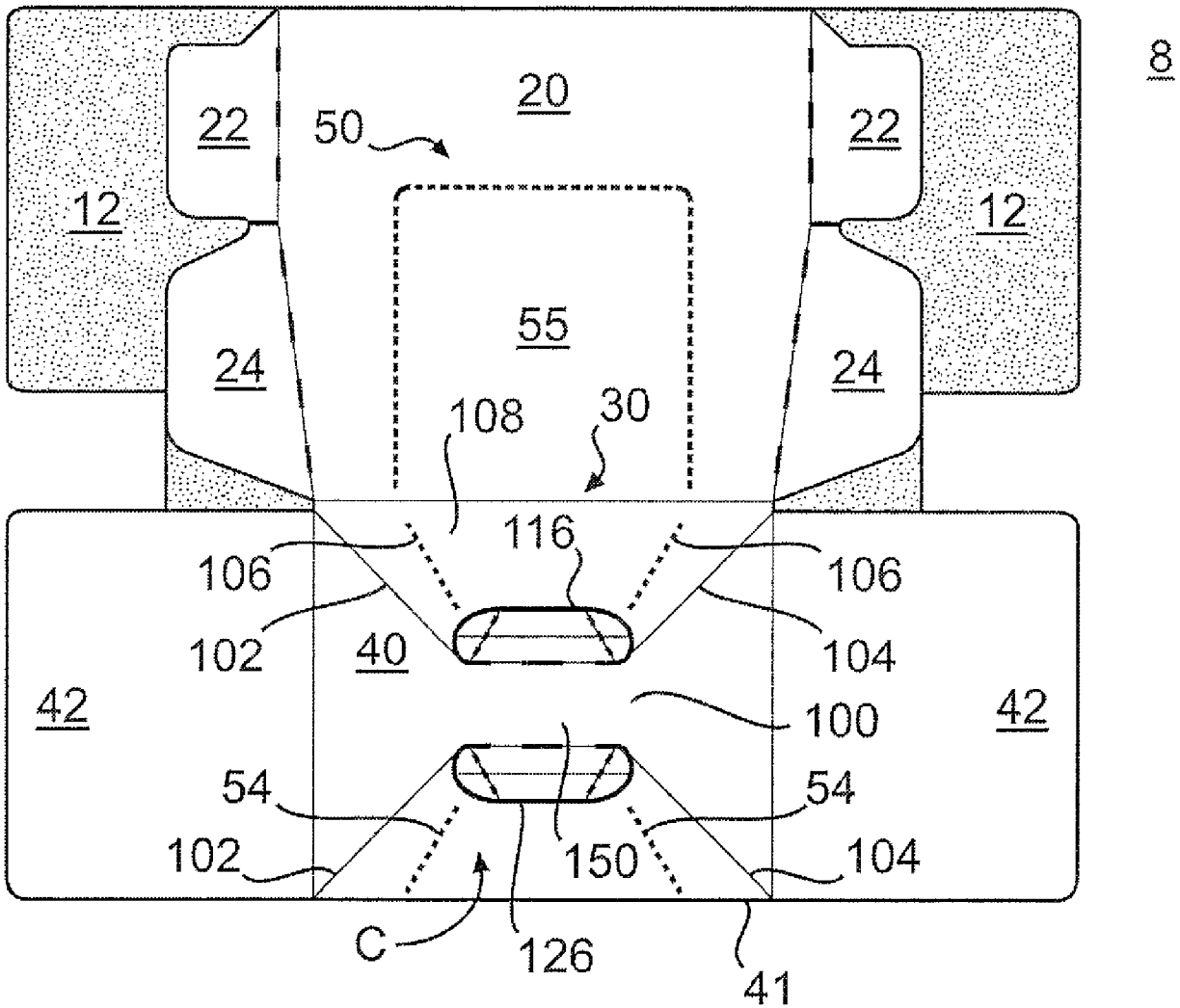
FIG. 2C illustrates an erection step of the blank according to the first embodiment.

Referring to FIG. 2C, the blank 8 is folded flat about the transverse fold line 41 in the direction of the arrow C so that the second top panel 40 overlaps and contacts the first top panel 30. The underside of the second handle portion 100 is adhered to the upper surface of the first handle portion 76 by the adhesive 101 (illustrated in FIG. 2B). All or a portion of the remainder of the underside of the second top panel 40 may also be adhered to selected sections of the exterior print surface of the first top panel 30. The undersides of the second top end flaps 42 may be adhered to the upper surfaces of the first top end flaps 32.

In the configuration illustrated in FIG. 2C, the second handle portion 100 overlies the first handle portion 76, which in turn overlies the folded reinforcing handle portion 70 (shown in FIG. 1), forming a three-ply handle 150. The oblique lines of disruption 106 defining the dispenser section 108 in the second top panel 40 overlap the oblique lines of disruption 54 in the first top panel 30 (shown in FIG. 1). Similarly, the oblique lines of disruption 54 in the second top panel 40 overlap the oblique lines of disruption 82 defining the dispenser section 88 in the first top panel 30. The handle feature 126 in the second top panel 40 overlies and may be adhered to the handle feature 86 in the first top panel 30 so that they may be accessed in a single motion.

Figure 2D:
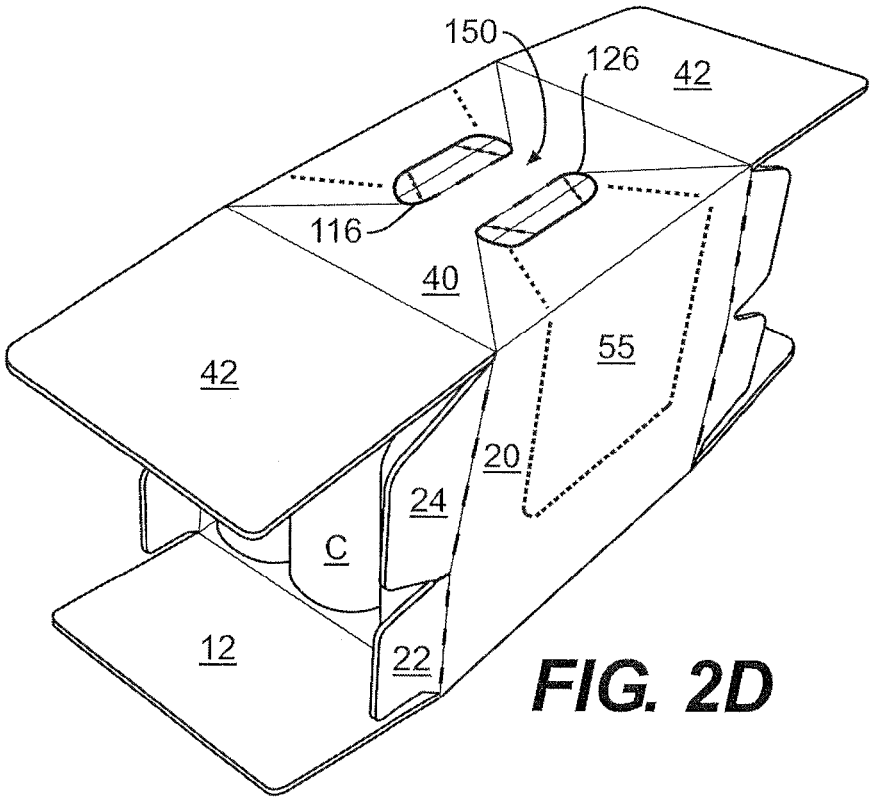
FIG. 2D illustrates an erection step of the blank according to the first embodiment.

FIG. 2D illustrates the partially folded and glued carton blank shown in FIG. 2C opened to form a generally tubular sleeve structure. The ends of the tubular sleeve may be closed, for example, by folding and gluing or otherwise adhering the end flaps 12, 22, 24, 32, 42 together. Articles such as, for example, bottle containers C may be loaded into the tubular sleeve in a conventional manner at any time before one or both ends of the carton are closed by the end flaps 12, 22, 24, 32, 42.

Figure 4:
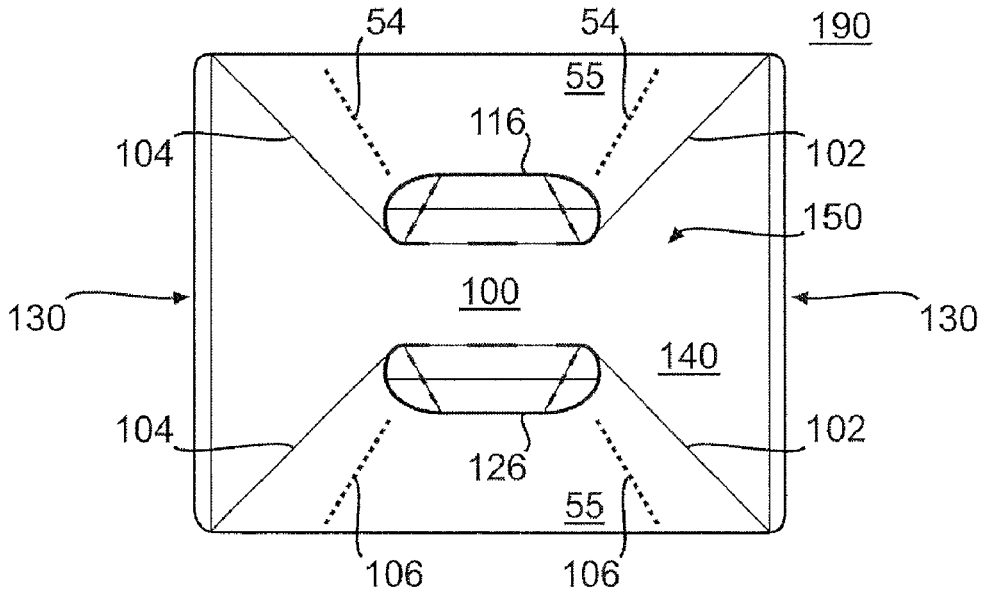
FIG. 4 is a top plan view of the carton.
Figure 5:
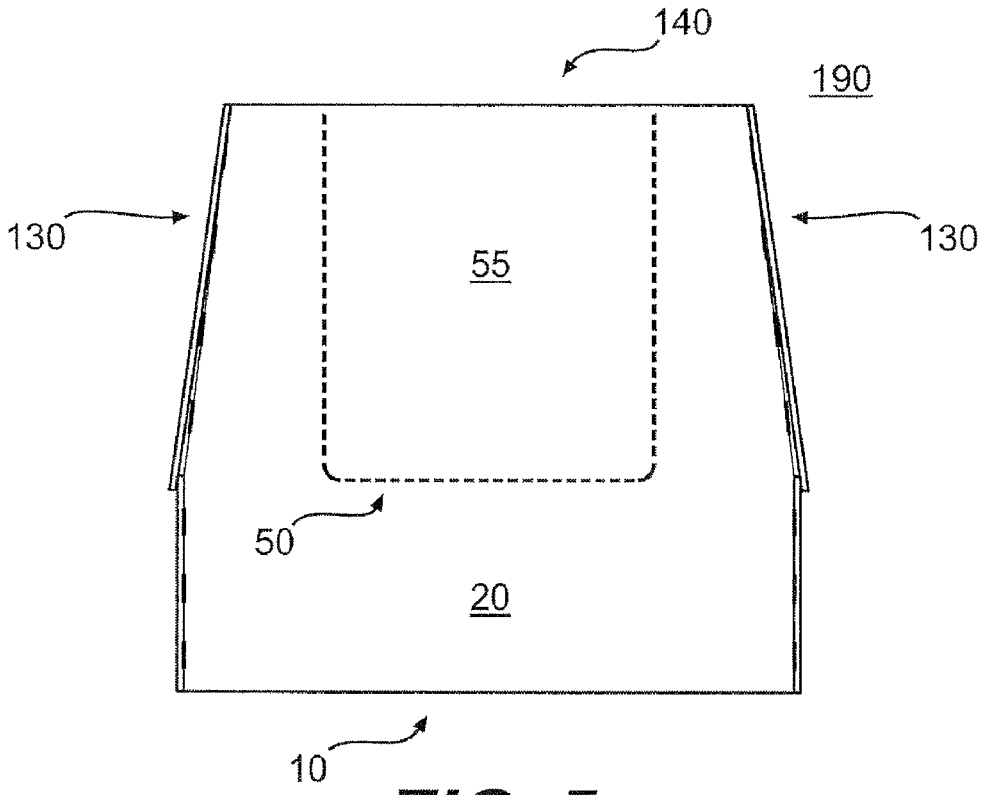
FIG. 5 is a front view of the carton.

FIGS. 3-5 illustrate the erected carton 190. In the erected carton 190, the adhered end flaps 12, 22, 24, 32, 42 form end panels 130 at each end of the carton 190. The end panels 130 may wholly or partially enclose the carton ends. The overlapped and adhered first and second top panels 30, 40 define a top panel 140 of the carton 190. The bottom panel 10, the side panels 20, the end panels 130 and the top panel 140 may define a substantially enclosed carton having a six-sided, generally parallelepipedal form. As shown in FIG. 3, the end panels 130 are not strictly planar and slope inwardly toward the top panel 140. Other end panel forms, such as retaining straps, gussets, planar panels, etc. can also be used.

According to one aspect of the invention, the overlapped first and second handle portions 100, 76 and the reinforcing handle portion 70 (illustrated in FIG. 1) form the three-ply handle 150 in the top panel 140. The three-ply handle 150 is elongated in shape and is generally disposed between the handle features 116, 126 in the top panel 140.

Figure 6:
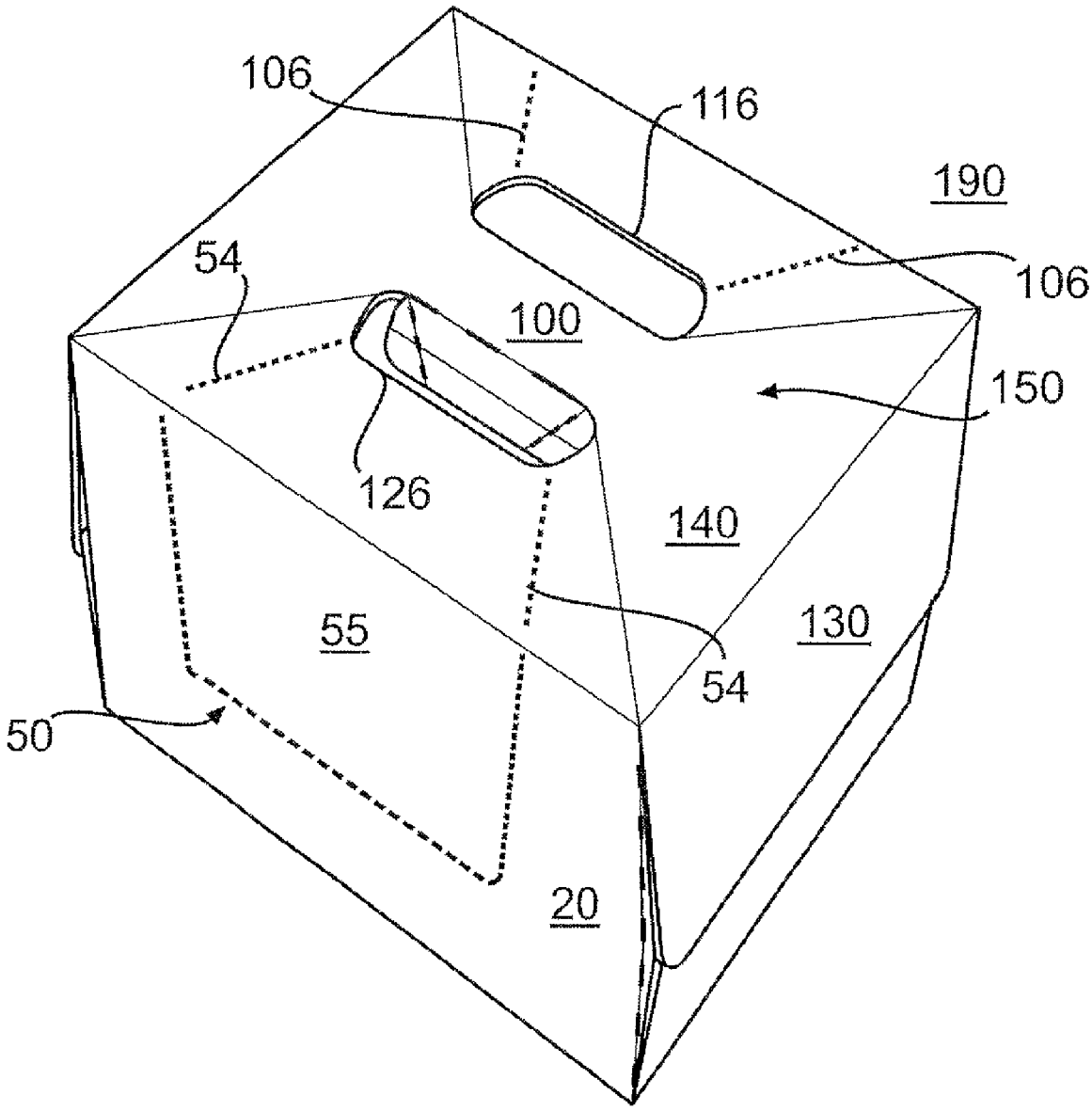
FIG. 6 illustrates the carton in a carrying configuration.

FIG. 6 illustrates the carton 190 in a carrying configuration. The carton 190 may be placed in the carrying configuration by breaching the top panel 140 at the handle feature 116, and/or at the overlapped handle features 126, 86 (the handle feature 86 illustrated in FIG. 1). The carton 190 and its contents can now be lifted and carried by the three-ply handle 150. When the carton 190 is lifted by the handle 150, the first top panel 30 (FIG. 1) may wholly or partially tear along the oblique lines of disruption 80, and the second top panel 40 may wholly or partially tear along the oblique lines of disruption 102, 104. This tearing may cause the handle 150 to lift slightly above the surface of the remainder of the top panel 140 during carrying of the carton 190. The oblique lines of disruption 80, 102, 104 provide a well-defined path for the top panel 140 to tear along during lifting of the carton 190, which may, for example, prevent inadvertent tearing along other sections of the top panel 140.

Figure 7:
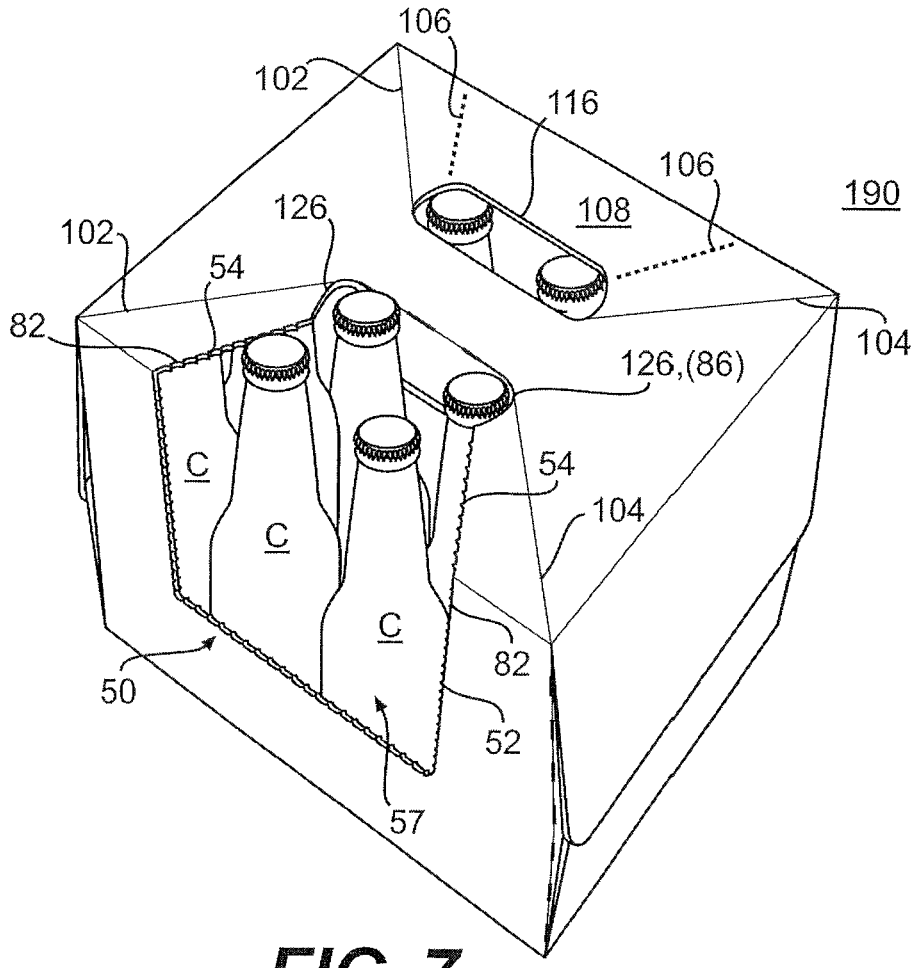
FIG. 7 illustrates the carton with an open dispenser and in the carrying configuration.
Figure 8:
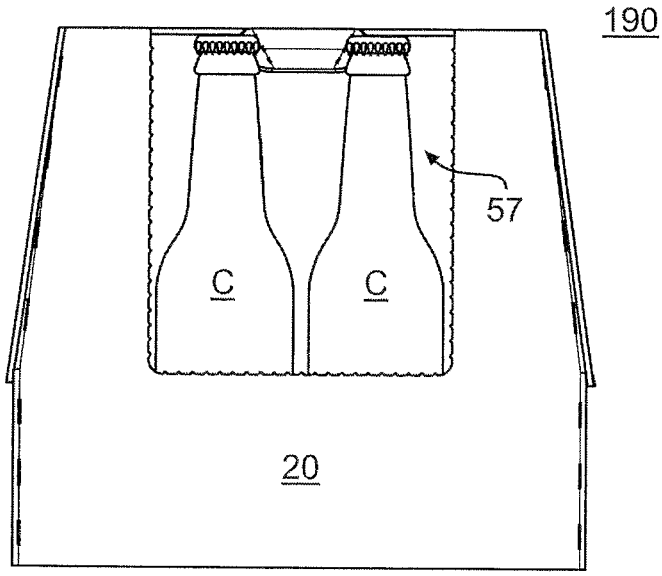
FIG. 8 is a front view of the carton with an open dispenser and in the carrying configuration.

Referring to FIG. 7, one side of the carton 190 may be opened by grasping the carton at the overlapping handle features 126, 86 (FIG. 1) and tearing the carton 190 downwardly along the tear lines 52, 54 to remove the dispenser section 55, and tearing along the oblique tear lines 82 to remove the dispenser section 88 in the first top panel 30 (illustrated in FIG. 1). The overlapping dispenser sections 55, 88 may be adhered to one another so that a single tearing action opens one side of the carton 190. Removing the dispenser sections 55, 88 forms a dispenser aperture 57 through which containers C accommodated in the carton 190 can be removed from the carton 190. If desired, the opposite side of the carton 190 can be opened by tearing along the tear lines 52, 54, 106 to remove the other dispenser sections 55, 108. FIG. 8 is a front view of the opened carton 190 illustrating the dispenser opening 57.

According to the above-described embodiment, the multi-ply carton handle 150 comprises three plies and is of high strength. Relatively heavy carton loads may therefore be transported using the handle 150. The handle 150 may be formed from plies formed from the overlapping top panels 30, 40 so that no additional paperboard pieces are required.

Also according to the above-described embodiment, dispenser sections may be formed on either or both sides of the multi-ply handle 150 to provide access to containers C accommodated in each side of the carton 190. When both sides of the carton 190 are opened, the carton may be carried by the handle 150.

In the illustrated embodiment, the exemplary carton 190 is dimensioned to accommodate beverage bottles. Other types of containers, however, can be accommodated within a carton according to the present invention. The dimensions of the blank 8 may also be altered, for example, to accommodate various container forms.

The lines of disruption 52, 54, 74, 80, 82, 102, 104, 106 illustrated in FIG. 1 generally indicate breachable (e.g. tearable) lines of disruption in the blank 8. Although each of these breachable lines may be specifically described as, for example, a cut line or a score line, etc., any line of disruption or weakening in the blank 8 that allows the blank 8 to be torn along these lines may be used. For example, tear lines of any form or type may be used to form the lines 52, 54, 74, 80, 82, 102, 104, 106.

The carton 190 illustrated above may accommodate, for example, twelve bottle containers C in a 3×4 arrangement. Different numbers of containers C can be accommodated, however, by adjusting the geometry and/or dimensions of the blank 8. For example, referring to FIG. 1, the width of the blank 8 along the transverse direction may be increased/decreased to accommodate additional/fewer columns of containers or other articles. Alternatively, the length of the blank 8 in the longitudinal direction may be increased/decreased to accommodate additional/fewer rows of containers.

In accordance with the exemplary embodiment, the carton may be constructed of paperboard, for example. The blanks, and thus the carton, can also be constructed of other materials, such as cardboard, or any other material having properties suitable for enabling the carton to function at least generally as described above. The blank can also be laminated to or coated with one or more blank-like materials at selected panels or panel sections. One or more panels of the blank can be coated with varnish, clay, or other materials, either alone or in combination. The coating may then be printed over with product, advertising, nutritional and other information or images. The blank may also be coated to protect any information printed on the blank. The blank may be coated with, for example, a moisture barrier layer, on either or both sides of the blank.

In accordance with the exemplary embodiment of the present invention, a fold line can be any substantially linear, although not necessarily straight, form of disruption or weakening in the blank that facilitates folding therealong. More specifically, but not for the purpose of narrowing the scope of the present invention, examples of fold lines include: score lines; crease lines; a cut or a series of cuts that extend partially into and/or completely through the material along a desired line of weakness; and various combinations of these features.

In the present specification, a "panel" or "flap" need not be flat or otherwise planar. A "panel" or "flap" can, for example, comprise a plurality of interconnected generally flat or planar sections. For example, the end panels 130 of the carton 190 illustrated in FIG. 3 are comprised of a plurality of overlapping flaps and may have a nonplanar shape.

For purposes of the description presented herein, the term "line of disruption" or "line of weakening" can be used to generally refer to, for example, a cut line, a score line, a crease line, a tear line, or a fold line (or overlapping and sequential combinations thereof) formed in a carton blank. A "breachable" line of disruption is a line of disruption that is intended to be breached during ordinary use of the carton. Examples of breachable lines of disruption are tear lines and cut lines.

The term "line" as used herein includes not only straight lines, but also other types of lines such as curved, curvilinear or angularly displaced lines.

The above embodiments may be described as having one or panels adhered together by glue or "glue lines." The term "glue" is intended to encompass all manner of adhesives commonly used to secure carton panels in place.

The description is not intended to limit the invention to the form disclosed herein. Also, it is intended that the appended claims be construed to include alternative embodiments, not explicitly defined in the detailed description.

What is claimed is:

1. A method of forming a carton from a blank, the method comprising:

obtaining a blank, the blank comprising:

a first top panel comprising a first handle portion, a handle feature located adjacent to the first handle portion, and a reinforcing handle portion located adjacent to the first handle portion, the reinforcing handle portion being foldably connected to the first top panel at a first fold line, wherein the first handle portion is located between the handle feature and the reinforcing handle portion and the reinforcing handle portion is at least partially defined by a breachable line of disruption in the first top panel;

a first side panel foldably connected to the first top panel at a second fold line, wherein the reinforcing handle portion is located between the first fold line and the second fold line;

a bottom panel;

a second top panel comprising a second handle portion; and a second side panel foldably connected to the second top panel;

folding the reinforcing handle portion of the first top panel about the first fold line so that it overlaps the first handle portion of the first top panel;

adhering the reinforcing handle portion to the first handle portion;

folding the blank so that the second top panel overlaps the first top panel and the second handle portion overlaps the first handle portion; and adhering the second top panel to the first top panel.

2. The method of claim 1, wherein an underside surface of the reinforcing handle portion is adhered to an underside surface of the first handle portion.

3. The method of claim 1, wherein the second top panel includes a second handle portion, wherein adhering the second top panel to the first top panel comprises adhering the second handle portion to the first handle portion.

4. The method of claim 3, wherein the reinforcing handle portion, the first handle portion, and the second handle portion overlap one another.

5. The method of claim 1, wherein an underside surface of the second top panel is adhered to an upper surface of the first top panel.

6. The method of claim 1, wherein the blank further comprises a pair of handle features in the second top panel, the second handle portion being located between the pair of handle features.

7. The method of claim 1, wherein the blank further comprises at least one dispenser pattern defining at least one dispenser section in at least one of the side panels.

8. The method of claim 1, further comprising:

forming the blank into a substantially tubular structure having a first end and a second end;

loading a plurality of containers into the substantially tubular structure; and at least partially closing at least one of the first end and the second end.

9. The method of claim 8, wherein the blank further comprises:

a pair of bottom end flaps foldably connected to the bottom panel; and a plurality of side end flaps connected to each side panel.

10. The method of claim 9, wherein the blank further comprises:

a pair of first top end panels foldably connected to the first top panel; and a pair of second top end panels foldably connected to the second top panel.

11. The method of claim 1, wherein a multi-ply handle is formed in the top panel, the multi-ply handle comprising at least three overlapping plies of paperboard formed from the first and second top panels, two plies of the multi-ply handle are comprised of the reinforcing handle portion of the first top panel overlapping and adhered to the first handle portion of the first top panel, and the first handle portion is located adjacent to the reinforcing handle portion and the handle feature.

12. The method of claim 11, wherein the second handle portion forms the third ply of the multi-ply handle.

13. The method of claim 1, wherein the reinforcing handle portion is spaced apart from a marginal edge of the first top panel.

14. The method of claim 1, wherein the reinforcing handle portion is spaced apart from a marginal edge of the blank.

* * * * *